US006503332B1

(12) United States Patent
Kawanishi et al.

(10) Patent No.: US 6,503,332 B1
(45) Date of Patent: Jan. 7, 2003

(54) WEB PARTICLE REMOVAL METHOD AND APPARATUS

(75) Inventors: Naoyuki Kawanishi, Minami-Ashigara (JP); Kazuhiko Fujiwara, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 78 days.

(21) Appl. No.: 09/625,320

(22) Filed: Jul. 25, 2000

(30) Foreign Application Priority Data

Jul. 29, 1999 (JP) ..... 11-215807

(51) Int. Cl.[7] ..... B08B 7/04

(52) U.S. Cl. ..... 134/1; 134/6; 134/10; 134/15; 134/34; 15/77; 15/100; 15/102

(58) Field of Search ..... 134/1, 6, 9, 10, 134/15, 34, 42; 15/77, 88.3, 100, 102, 230

(56) References Cited

U.S. PATENT DOCUMENTS

| | | | | | |
|---|---|---|---|---|---|
| 3,052,244 | A | | 9/1962 | Gley | 134/64 |
| 3,635,762 | A | | 1/1972 | Ott et al. | 134/1 |
| 3,698,408 | A | * | 10/1972 | Jacke | 134/122 |
| 4,244,078 | A | * | 1/1981 | Hughes et al. | 15/302 |
| 4,294,533 | A | * | 10/1981 | Bratt et al. | 354/318 |
| 5,329,341 | A | * | 7/1994 | Nowak et al. | 355/273 |
| 5,486,236 | A | * | 1/1996 | Townsend et al. | 134/13 |
| 5,779,909 | A | * | 7/1998 | Tomita et al. | 134/15 |
| 5,897,726 | A | * | 4/1999 | Shinkai et al. | 118/106 |
| 5,902,412 | A | * | 5/1999 | Taylor | 134/12 |
| 6,143,091 | A | * | 11/2000 | Saito et al. | 134/15 |
| 6,158,075 | A | * | 12/2000 | Tanaka et al. | 15/102 |
| 6,308,369 | B1 | * | 10/2001 | Garcia et al. | 15/230 |

FOREIGN PATENT DOCUMENTS

| | | | |
|---|---|---|---|
| EP | 0 869 077 A1 | 10/1998 | B65D/65/40 |
| JP | 49-13020 | 3/1974 | G03C/1/00 |
| JP | 59-150571 | 8/1984 | B05D/3/00 |
| JP | 62-60749 | 3/1987 | B65H/23/00 |
| JP | 62-65872 | 3/1987 | B65H/23/00 |
| JP | 10-290964 | 11/1998 | B08B/5/00 |
| JP | 10-309553 | 11/1998 | B08B/11/00 |

OTHER PUBLICATIONS

Japanese Abstract No. 10268498, dated Oct. 9, 1998.

* cited by examiner

*Primary Examiner*—Alexander Markoff
(74) *Attorney, Agent, or Firm*—Sughrue Mion, PLLC

(57) ABSTRACT

A part of a drive roller, whose peripheral surface is coated with an elastic body, is immersed in a cleaning liquid, and the rotation of the drive roller causes the surface of the elastic body to be wet with the cleaning liquid. The elastic body wet with the cleaning liquid continuously rubs a surface of a film being fed. Then, a wash nozzle sprays a cleaning liquid to the surface that has been rubbed by the elastic body. A shearing stress of the elastic body rubs off foreign matter adhering to the film. The foreign matter that has not been rubbed off by the elastic body is washed off by the cleaning liquid sprayed from the wash nozzle.

2 Claims, 3 Drawing Sheets

FIG. 3

| LEVEL MARK | RUBBING MEANS | ROTATING DIRECTION | REVOLUTIONS PER MINUTE (rpm) | CIRCULATED FLOW (L/min) | ULTRASONIC WAVE | AFTER PROCESS OF 50m | AFTER PROCESS OF 3000m | |
|---|---|---|---|---|---|---|---|---|
| | | | | | | NUMBER OF FOREIGN MATTERS (PARTICLES/m) | NUMBER OF FOREIGN MATTERS (PARTICLES/m) | NUMBER OF SCRACHES |
| A (PRIOR ART) | WIRE BAR | REVERSE TO TRANSPORT DIRECTION | 10 | - | - | 30 | 35 | A FEW |
| B (PRIOR ART) | WIRE BAR | REVERSE TO TRANSPORT DIRECTION | 50 | - | - | 22 | 27 | MANY |
| C (PRIOR ART) | BLADE | - | - | - | - | 47 | 53 | COUNTLESS |
| D(COMPARATIVE ART) | COATED ROLLER | REVERSE TO TRANSPORT DIRECTION | 10 | 0 | OFF | 19 | 38 | A FEW |
| E(COMPARATIVE ART) | COATED ROLLER | REVERSE TO TRANSPORT DIRECTION | 50 | 0 | OFF | 12 | 27 | A FEW |
| F (PRESENT INVENTION) | COATED ROLLER | REVERSE TO TRANSPORT DIRECTION | 10 | 30 | OFF | 12 | 15 | NONE |
| G (PRESENT INVENTION) | COATED ROLLER | REVERSE TO TRANSPORT DIRECTION | 50 | 30 | OFF | 7 | 10 | NONE |
| H (PRESENT INVENTION) | COATED ROLLER | REVERSE TO TRANSPORT DIRECTION | 50 | 30 | ON | 2 | 1 | NONE |
| I (PRESENT INVENTION) | COATED ROLLER | SAME AS TRANSPORT DIRECTION | 100 | 30 | ON | 5 | 5 | NONE |

WEB PARTICLE REMOVAL METHOD AND APPARATUS

BACKGROUND OF THE INVENTION

1. Field of the Invention

The present invention relates generally to a web particle removal method and apparatus, and more particularly to a web particle removal method and apparatus that is capable of precisely removing foreign matter, such as debris, dust, and the like adhering to a surface of a thermoplastic base material.

2. Description of Related Art

Photosensitive material, magnetic recording tape, film for optical use, and the like are manufactured by adding respective functions to a thermoplastic base material (which can only be called a "web") in order to express industrial values. Many of these products are manufactured by coating the surface of the thermoplastic base material with a photosensitive substance, a magnetic substance, a light-transforming substance, and the like. In recent years, an applying speed of these substances has been raised in order to improve the productivity. If foreign matter, such as debris, dust and the like adheres to the surface of the base material, a coating defect may be several hundred times larger than the size of the particle of the foreign matter. To solve this problem, a so-called particle removal process is executed to forcibly remove the foreign matter such as the particle adhering to the surface of the base material prior to the coating.

The foreign matter adheres to the surface of the base material for a variety of reasons as follows. Some foreign matter existing on the surface of a film is embedded in the surface before the film is solidified during the film formation. Some foreign matter adheres to the surface due to intermolecular force from the formation of a film to the coating of a functional material. Some foreign matter adheres to the surface due to electrostatic force generated by the electrification of a film surface. Some foreign matter adheres to the surface in such a manner that a liquid including a solid matter adheres to the surface and is then dried and solidified. The foreign matter has a variety of compositions and a variety of adhesions with respect to the film. The coating defect results from the foreign matter particle of submicron to several millimeters.

In a well-known dry process particle removal method, a non-woven fabric or a blade is pressed against the surface of a film as disclosed in Japanese Patent Provisional Publication No. 59-150571. In a method disclosed in Japanese Patent Provisional Publication No. 10-309553, the air with a high cleanliness is jetted at a high speed to exfoliate the deposits from the surface of the film and guide them into a near inlet. Shinko Ltd. commercially produces a "New Ultra Cleaner (trademark)" that exfoliates and sucks the deposits by jetting the compressed air vibrated by ultrasonic waves. This cleaner is characterized in that a shearing stress of airflow is combined with the vibration by the ultrasonic waves in order to improve particle removing performance.

Japanese Patent Provisional Publication No. 10-290964 discloses another dry process particle removal method, wherein positive and negative air ions are implanted to neutralize electric charges to thereby remove the exfoliated foreign matter by another air flow.

There is also a wet process particle removal method. In an example of the wet process particle removal method, a film is guided into a cleaning liquid vessel to exfoliate the deposits by means of an ultrasonic generator. In another example of the wet process particle removal method, a cleaning liquid is supplied to a film, and the air is then jetted to the film at a high speed and the deposits are sucked as disclosed in Japanese Patent Publication No. 49-13020.

Although the above-mentioned particle removal methods are effective for the relatively-large deposits of dozens of micrometers or more or the deposits with a low adhesion, they are hardly effective for small deposits of several micrometers or less or deposits with a strong adhesion.

To address this problem, Japanese Patent Publication No. 5-50419 has proposed a method which comprises the steps of applying a solvent on the surface of the film and then pressing a rod member, which is rotating in a reverse direction to a film transporting direction, against the surface of the film to scrape off the deposits while the solvent is remaining. In this method, a small gap is formed between the film and the rod member in order to prevent the passage of deposits larger than the gap, and a shearing stress is transmitted through the solvent to exfoliate the deposits. Therefore, this method is effective for small deposits with a strong adhesion.

Japanese Patent Provisional Publication No. 62-65872 has proposed another particle removal method in that a blade with a sharp edge is provided instead of the rod member, which is rotating in a reverse direction to the film transport direction, to thereby improve a cleaning effect.

In the methods disclosed in Japanese Patent Publication No. 5-50419 and Japanese Patent Provisional Publication No. 62-65872, the rod member or the like is formed of a flat hard metal with an excellent abrasion resistance so that the rod member or the like can be in direct contact with the surface of the thermoplastic base material. For this reason, the film is damaged when a solid foreign matter enters the gap between the film and the rod member or the like. Moreover, when a liquid film between the film surface and the rod member or the like is broken, the film surface is damaged and new foreign matter is generated.

SUMMARY OF THE INVENTION

It is therefore an object of the present invention to provide a web particle removal method and apparatus that is able to remove foreign matter, such as debris, dust and the like adhering to the surface of a web-shaped roll without damaging it.

The above object can be accomplished by providing a web particle removal method, comprising the steps of: rubbing continuously a surface of a running web with an elastic body wet with a liquid; and after the rubbing step, spraying a liquid to the surface of the running web.

In the method of the present invention wherein the film surface is rubbed with the elastic body accompanied by the liquid, a shearing stress is thousands of times as large as that in a dry process particle removal method using a gaseous medium at the same shearing speed. Therefore, the particle removal method of the present invention can remove smaller foreign matter with a stronger adhesion compared with the dry process particle removal method. Since the elastic body has a lower rigidity than a metal rod and a blade, there is extremely little possibility that the elastic body pressed against the film damages the film surface.

The foreign matter that cannot be rubbed off by the shearing stress of the elastic body, and the foreign matter that adheres again to the film surface in company with the liquid, are washed off by spraying a liquid to the surface of the film at the downstream side of the elastic body.

The foreign matter, which has been rubbed off from the film surface, partially remains on the surface of the elastic body. This is accumulated as time passes, and adheres again to the film surface. This lowers a foreign matter removal ratio, and damages the film if the rigidity of the remaining foreign matter is higher than that of the film. To solve this problem, ultrasonic waves are applied to the surface of the elastic body in order to remove the transferred foreign matter after the rubbing of the film according to the present invention.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 3 is a chart showing the results of experiments in various examples.

DETAILED DESCRIPTION OF THE PREFERRED EMBODIMENT

A preferred embodiment of the present invention will be described hereinbelow with reference to the accompanying drawings.

Figure 1:
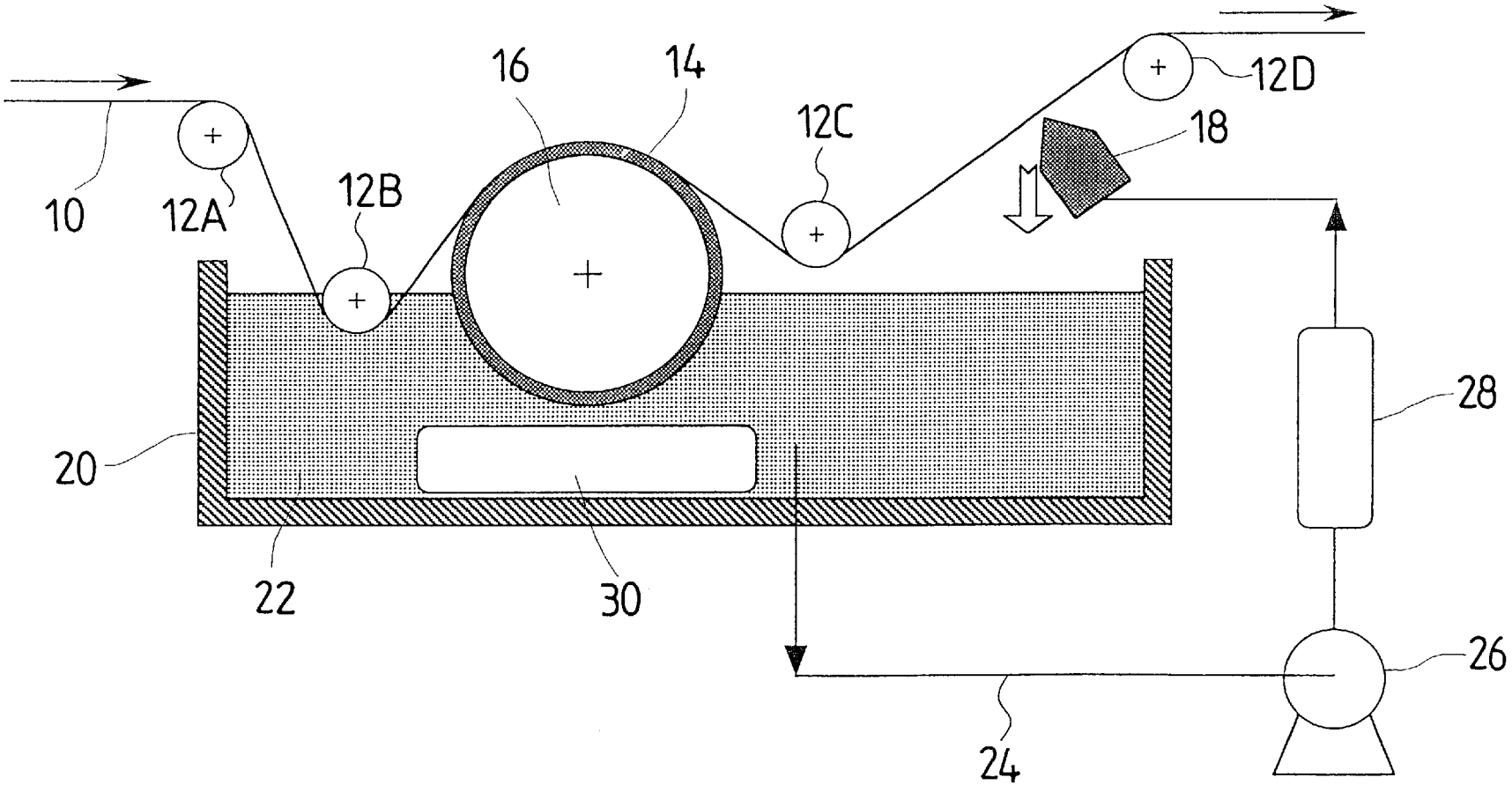
FIG. 1 is a conceptual view showing a preferred embodiment of a web particle removal apparatus according to the present invention.

FIG. 1 is a conceptual view showing a web particle removal apparatus according to an embodiment of the present invention. As shown in FIG. 1, the particle removal apparatus of this embodiment comprises guide rollers 12A–12D for guiding a web-shaped film 10; a drive roller 16 for continuously rubbing the film 10, which is guided by the guide rollers 12A–12D, with an elastic body 14 covering the drive roller 16; and a wash nozzle 18 for washing the surface of the film 10 that has been rubbed with the drive roller 16.

A roll of the film 10 is unwound in a feeding apparatus (not shown), and the film 10 is guided to the particle removal apparatus. Then, the film 10 is transported from the left side to the right side in the particle removal apparatus in FIG. 1, and is finally guided to a winding apparatus where the film 10 is rewound in a roll.

The film 10 to be processed in the web particle removal apparatus according to the present invention may be polyester, polyethylene terephthalate, polyethylene naphthalene, cellulose nitrate, cellulose ester, polyvinylacetal, polycarbonate, polyvinylchloride, polyvinyledenchloride, polyimide, polyamide, the related or resin materials, and paper, metal, and the like. The film 10 is typically a flexible base material, and more particularly a paper base material, which is partially acetylated or is coated with baryta and/or α-olefin polymer, and more particularly α-olefin polymer whose number of carbons is between 2 and 10 such as polyethylene, polypropylene and ethylene-butene copolymer. These thermoplastic base materials are provided with various functions to realize industrial values. Typical examples are photosensitive material, magnetic recording tape and film for optical use. The surfaces of many thermoplastic materials are coated with a photosensitive substance, a magnetic substance, a light-transforming substance, and the like.

The guide rollers 12A–12D guide the film 10 traveling through the particle removal apparatus. The guide rollers 12A–12D are provided at predetermined respective positions. In this case, it is important that the guide rollers 12A–12D guide the film 10 to bring the film 10 into contact with the elastic body 14 at a positive lap angle with respect to the drive roller 16, and that the rubbed surface of the film 10 can be close to the wash nozzle 18 arranged behind the drive roller 16.

The drive roller 16 is positioned between the guide roller 12B and the guide roller 12C, and is rotated by a motor (not shown). The drive roller 16 is constructed in such a manner that the peripheral surface of a roller is coated with the elastic body 14. The lower half of the drive roller 16 is immersed in a cleaning liquid 22 held in a cleaning liquid vessel 20. The film 10 is continuously rubbed over the elastic body 14 covering the surface of the rotating drive roller 16, so that the foreign matter adhering to the surface of the film 10 is removed.

Since the lower half of the drive roller 16 is immersed in the cleaning liquid 22, the rotation of the drive roller 16 causes the elastic body 14 covering the surface of the drive roller to be always wet with the cleaning liquid 22. This generates a shear stress, against the foreign matter adhering to the surface of the film 10, thousands of times as large as that in a dry particle removal method using a gaseous medium, and makes it possible to remove smaller foreign matter that strongly adheres to the surface of the film 10.

The drive roller 16 may be rotated either forward or backward with respect to the transport direction of the film 10, and the diameter and the rotating speed of the drive roller 16 are preferably determined so that an absolute value of a difference in linear velocity between the film 10 and the drive roller 16 can be maintained at not less than 5 m/min.

The surface of the drive roller 16 is coated with the elastic body 14 with a thickness of at least 0.5 mm, preferably between 0.5 mm and 100 mm, and more preferably between 1.0 mm and 50 mm. A coating material may be selected from a variety of known materials. Examples of the coating materials are a polyamide such as 6-nylon, 66-nylon and copolymer nylon; a polyester such as polyethylene terephthalete, polybutylene terephthalete and copolymer polyester; a polyolefin such as polyethylene and polypropylene; a polyhalogenated vinyl such as polyvinylchloride, polyvinyledenfluoride and polytetrafluoroethylene (Teflon®); natural rubber; neoprene rubber; nitrile rubber; fluorinated rubber; chlorosulfonated polyethylene (Hypalon®); polyurethane; rayon; and cellulose. These elastic bodies may be used either alone, in combination, as a laminate, or as a non-woven fabric with which fiber is interwoven. A material is selected which is never softened or eluted by the cleaning liquid, and is selected so that the rigidity thereof can be lower than the rigidity of the film surface so as not to damage the film being rubbed.

The lap angle of the film 10 with respect to the drive roller 16 is determined according to the positions of the guide rollers 12B, 12C arranged before and behind the drive roller 16. The increase in the lap angle leads to the increase in the stay time of the passing film 10 on the drive roller 16. This achieves an excellent cleaning effect. In order to transport the film 10 in stable conditions without wrinkling, scratching or snaking it, however, it is preferable to set the lap angle of the film 10 at less than 180 degrees, preferably at least 1 degree and less than 135 degrees, and more preferably at least 5 degree and less than 90 degrees. The increase in the diameter of the drive roller 16 can also lead to the increase in the stay time, but the diameter is preferably less than 200 cm to reduce space occupation and production costs, more preferably not less than 5 cm and less than 100 cm, and still more preferably not less than 10 cm and less than 50 cm.

The bearing stress applied to the film 10 on the drive roller 16 is determined according to a tension of a film transport system and the diameter of the drive roller 16. It is preferable to control the tension of the transport system since the diameter of the drive roller 16 is related to the stay time. It is preferable to maintain a high bearing stress in order to remove the foreign matter. If, however, the bearing stress is too high, a liquid film of the cleaning liquid between the film 10 and the elastic body 14 is broken to bring the elastic body 14 into direct contact with the film 10, which is therefore scratched. The bearing stress is preferably not greater than 100 kgf/m width, more preferably between 5 kgf/m width and 100kgf/m width, and still more preferably between 5 kgf/m width and 50 kgf/m width.

The wash nozzle 18 is positioned between the guide roller 12C and the guide roller 12D, and sprays the cleaning liquid on the surface of the film 10 that has been rubbed by the drive roller 16. The cleaning liquid to be sprayed from the wash nozzle 18 is obtained by purifying the cleaning liquid 22 held in the cleaning liquid vessel 20. More specifically, the cleaning liquid vessel 20 and the wash nozzle 18 are connected through a pipe 24, and the cleaning liquid 22 held in the cleaning liquid vessel 20 is pulled out by a conveying pump 26 arranged in the middle of the pipe 24 and is purified by a filter 28. The filtered cleaning liquid is supplied to the wash nozzle 18 and is sprayed from the wash nozzle 18. The cleaning liquid sprayed from the wash nozzle 18 washes the surface of the film 10 that has been rubbed by the elastic body 14 of the drive roller 16. This washes off the foreign matter that has not been rubbed off by the shearing stress of the elastic body 14, and the foreign matter that has adhered again to the film 10 in company with the liquid. The cleaning liquid sprayed from the wash nozzle 18 strikes against the surface of the film 10 that has been rubbed by the elastic body 14 of the drive roller 16, and falls by its self-weight into the cleaning liquid vessel 20. In short, the cleaning liquid is recycled.

The cleaning liquid that has been contaminated by the foreign matter falling from the film may be purified by the liquid circulation system, which supplies the cleaning liquid to the wash nozzle 18 behind the drive roller 16, or may be filtered by another liquid circulation system. A variety of filters are used according to the size of foreign matter to be removed. A nominal fractional size of the filter is half the size of the foreign matter to be separated, and more preferably half to one tenth. It is advantageous to select a pleated cartridge filter in view of the life of the filter and the easy use.

The filtered circulated flow should be determined in such a manner as to prevent the increase in the amount of foreign matter accumulated in the cleaning liquid vessel as the time passes due to the foreign matter carried from the film surface. In order to quantify the amount of foreign matter floating in the cleaning liquid, it is convenient to use a "HIAC/ROYCO Liquid Particle Counter Model 4100" of Nozaki Industries. The fractional size of the filter and the circulated flow are adjusted in such a manner as to prevent the increase in the number of particles in sizes to be removed as the operating time passes.

The cleaning liquid 22 is preferably a liquid that never dissolves or extracts the components of the film or an undercoat incorporated in the surface of the base material by coating and the like, or a liquid that never permeates them. If a water-soluble substance such as a gelatin is provided as the undercoat, a nonaqueous solvent with a low polarity is selected. Examples of solvent for use in the present invention are mentioned in "A New Edition Solvent Pocketbook (published by Ohm-sha, 1994, Japan)", but the present invention should not be restricted to them. The boiling point of the solvent for use in the present invention is preferably between 30° C. and 80° C. in view of the quick dryness, and the viscosity thereof is preferably at most 50 mPa·s at a service temperature in view of the handleability of the cleaning liquid. The cleaning liquids may be used either alone or in combination.

In FIG. 1, an ultrasonic generator 30 is provided in the cleaning liquid vessel 20. The ultrasonic generator 30 applies ultrasonic waves to the surface of the elastic body 14 covering the surface of the drive roller 16 to thereby remove the transferred foreign matter. The cleaning liquid 22 is held between the ultrasonic generator 30 and the elastic body 14 in order to efficiently transmit the generated ultrasonic waves to the surface of the elastic body 14.

Preferably, the ultrasonic generator 30 has a larger width than the drive roller 16 in the surface that radiates the ultrasonic wave, and at least 50% of the roller diameter in the film transport direction is projected on the radiation surface of the ultrasonic generator 30. If the size of one ultrasonic generator is smaller than this size, a plurality of ultrasonic generators are arranged to cover the equivalent projection area. In this case, the intervals between the ultrasonic generators should be determined so that the ultrasonic waves from the adjacent ultrasonic generators can be uniformly overlapped.

Moreover, the frequency of the ultrasonic generator 30 may be from a normal frequency of 20 kHz and over 1 MHz. If the material of the drive roller 16 is susceptible to cavitation and erosion, the frequency of less than 500 kHz may damage the surface of the elastic body. Therefore, it is preferable to use the ultrasonic generator with one or more megahertz frequency although it is expensive. Different frequencies act on different sizes of foreign matter (the higher the frequency is, the smaller the size of foreign matter is acted on), and it is therefore possible to use a plurality of ultrasonic generators that generate ultrasonic waves of different frequencies, or an ultrasonic generator that is capable of modulating the generating frequency.

The ultrasonic output per unit area is between 0.1 $W/cm^2$ and 2 $W/cm^2$. The distance between the ultrasonic generator 30 and the drive roller 16 has optimum points due to the presence of a standing wave, and the distance is preferably a value that is found by multiplying a value calculated according to the following formula by an integer:

$$\lambda = C/f$$

where $\lambda$ is a wavelength of the ultrasonic wave, C is an ultrasonic wave transmission speed in the cleaning liquid, and f is a frequency of the ultrasonic wave.

There will now be described the operation of the web particle removal apparatus according to this embodiment that is constructed in the above-mentioned manner.

The film 10 guided into the particle removal apparatus is transported in the state of being guided by the guide rollers 12A–12D, and in the meantime, the surface of the film 10 is continuously rubbed with the elastic body 14 of the rotating drive roller 16. This removes the foreign matter adhering to the surface of the film 10.

The rotation of the drive roller 16 causes the elastic body 14 covering the surface of the drive roller to be always wet with the cleaning liquid 22. This applies a shearing stress thousands of times as large as that in a dry particle removal method using a gaseous medium, and makes it possible to easily remove smaller foreign matter that strongly adheres to the surface of the film 10. Since the elastic body 14 has a smaller rigidity than a metal rod or blade, there is an extremely little possibility that the elastic body 14 scratches or damages the surface of the film 10 against which the elastic body 14 is pressed.

When the elastic body 14 having rubbed the film 10 rotates and passes through the cleaning liquid 22 held in the cleaning liquid vessel 20, the ultrasonic generator 30 applies the ultrasonic waves to the surface of the elastic body 14. Therefore, even if the foreign matter rubbed off the surface of the film 10 adheres to the surface of the elastic body 14, the ultrasonic vibration can remove them when the elastic body 14 passes through the cleaning liquid. Thus, the elastic body 14 that is kept clean rubs the film 10, and this prevents the residual foreign matter and the like from damaging the film 10.

The wash nozzle 18 sprays the cleaning liquid to the film 10 having been rubbed by the elastic body 14 at the downstream side. This washes off the foreign matter that has not been rubbed off by the shearing stress of the elastic body 14, and the foreign matter that has adhered again to the film 10 in company with the cleaning liquid.

The cleaning liquid that is sprayed from the wash nozzle 18 is the cleaning liquid 22 that is held in the cleaning liquid vessel 20 and is purified by the filter 28. Thus, the foreign matter having been removed from the film 10 never adheres to the film 10 again.

As stated above, the web particle removal apparatus of this embodiment is able to remove the foreign matter, such as the debris, dust, and the like adhering to the surface of the film 10 without scratching or damaging it.

In this embodiment, there is provided only one drive roller 16, but the present invention should not be restricted to this. If the film 10 is highly contaminated, it is possible to provide a plurality of drive rollers. In this case, one wash nozzle may be added per drive roller, and the wash nozzle may be provided downstream of the plurality of drive rollers 16 arranged in series.

The cleaning liquid vessel 20 holding the cleaning liquid 22 may be provided with a jacket structure to circulate a heat medium or a heat exchanger, in which a heat medium is circulated, immersed in the cleaning liquid 22, so as to absorb the heat generated by the ultrasonic generator 30 and the conveying pump 26, and thereby maintain a constant temperature of the cleaning liquid 22.

In this embodiment, the cleaning liquid sprayed from the wash nozzle 18 is recycled by purifying the cleaning liquid 22 held in the cleaning liquid vessel 20, but it is also possible to supply the cleaning liquid from a separately-provided cleaning liquid tank.

EXAMPLE

There will now be described the present invention by examples, but it should be understood that there is no intention to limit the present invention to these examples.

Example 1

(Prior Art)

Figure 2:
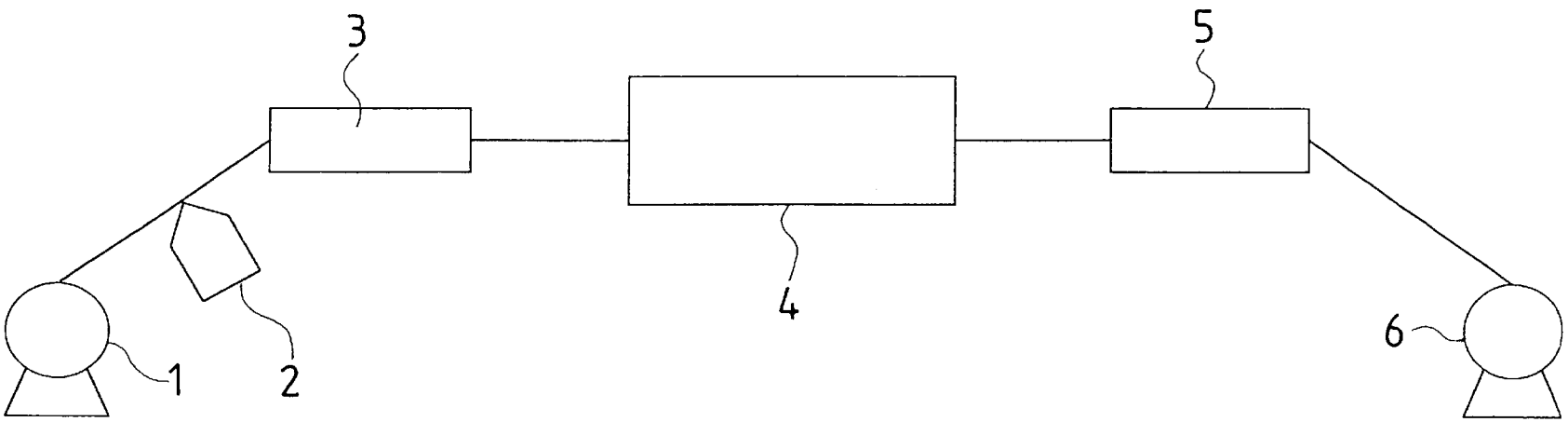
FIG. 2 is a conceptual view showing a transport apparatus to which a web particle removal apparatus according to the present invention is applied.

A transport apparatus in FIG. 2 fed a polyethyleneterephthalate film with a thickness of 100 $\mu$m and a width of 100 cm at a speed of 50 m/min from a feeding apparatus 1. A coating head 2 coated the film with a coating liquid including latex with a mean particle size of 10 $\mu$m. The coating liquid was dried in a first drying zone 1 to produce a film with a controlled deposit of foreign matter.

The composition of the coating liquid including the latex was as follows.

| | |
|---|---|
| Undiluted latex solution | 1.0 $cm^3$ |
| Methanol | 49.0 $cm^3$ |
| Pure water | 50.0 $cm^3$ |

The undiluted latex solution included a monodisperse polyethylene latex of 1 weight %. The coating liquid of was applied on the film by 25 $cm^3/m^2$. The dried film surface was observed through a microscope, and it was found that latex particles uniformly adhered to the film surface at a density of about 300 (particles)/$m^2$.

Then, the film is guided to a wet process particle removal zone 4 in FIG. 2 without its coated surface being in contact with a roller and the like. A particle removal process was executed in the wet process particle removal zone 4 as disclosed in Japanese Patent Publication No. 5-50419. A fountain coater applied methanol on the film by 20 $cm^3/m^2$, and then a rotating wire bar with a length of 1.1 m along the width of the film and a diameter of 10 mm was pressed against the film along the width thereof to remove the particle. A tension of the film was separated before, within, and behind the wet process particle removal zone 4. The tension of the film was 12 kgf/m width in the wet process particle removal zone 4.

Then, the solvent was dried in a second drying zone 5 in FIG. 2 without the particle-removed surface being in contact with the roller and the like, and a winding apparatus 6 wound the film. A sample of 1m in the transport direction between the second drying zone 5 and the winding apparatus 6 was obtained for evaluating the particle removal effect, and the residual latex particles were counted through a stereoscopic microscope with a magnification of 50×. When the film surface was damaged, the extent of the damage was recorded. Evaluation ranks are as follows.

If the number of scratches=several/m, the evaluation rank is "a few".

If the number of scratches=dozens/m, the evaluation rank is "many".

If the number of scratches=hundred/m or more, the evaluation rank is "countless".

The sampling was performed two times after the continuous process of 50 m and after the continuous process of 3,000 m.

A level A and a level. B in FIG. 3 show the results of experiments wherein a wire bar, which rotated at a speed of 10 rpm and a speed of 50 rpm, respectively, in a reverse direction with respect to the film transport direction, rubbed the film. The number of latex particles was decreased to about 1/10 from 300/m before the particle removal process, but the amount of foreign matter after the process of 3000 m was slightly larger than after the process of 50 m and the film surface was scratched.

Example 2

(Prior Art)

A wet process particle removal was performed after adhering the latex particles as is the case with the example 1. In the example 2, an SUS304 blade for a blade coater with a length of 1.1 m along the width of the film and a tip thickness of 0.5 mm was attached along the width of the film instead of the rotary wire bar in the wet process particle removal zone 4 just after the fountain coater, which applied methanol on the film by 20 $cm^3/m^2$.

A level C in FIG. 3 shows the results of the experiment. The number of residual latex particles was larger than that of the levels A and B, and the countless scratches were formed on the film surface.

Example 3

(Comparative Art)

A wet process particle removal was performed after adhering the latex particles as is the case with the example 1. In the example 3, the surface of an aluminum roller with a length 1.1 m along the width of the film and a diameter of 20 cm was covered with fluorinated rubber with a thickness of 10 mm as shown in FIG. 1, and the roller was provided as the drive roller in the wet process particle removal zone 4 in FIG. 2. The guide rollers before and behind the drive roller were arranged so that the lap angle of the film with respect to the drive roller was 50 degrees, and the lower part of the drive roller coated with the fluorinated rubber was immersed by 10 cm in methanol. The drive roller was rotated in a reverse direction with respect to the film transport direction.

A level D and a level E in FIG. 3 show the results of experiments wherein the drive roller, which rotated at a speed of 10 rpm and a speed of 50 rpm, respectively. Compared with the prior arts of the levels A–C, the amount of foreign matter was decreased after the process of 50 m. This means the excellent particle removal operation of the drive roller. However, the amount of foreign matter was doubled after the process of 3,000 m, and this means that the drive roller cannot achieve the excellent removal operation for a long period of time. After the particle removal of 3,000 m, it was found that the surface of the fluorinated rubber was whitish with the latex particles adhering thereto.

Example 4

(Present Invention)

A wet process particle removal was performed by using the drive roller as is the case with the example 3. In the example 4, the wet process particle removal zone 4 was provided with a liquid supply apparatus, which circulated and filtered methanol and supplied it to a wash nozzle, and the ultrasonic generator in addition to the aluminum roller coated with the fluorinated rubber as shown in FIG. 1.

The wash nozzle was 100 cm long along the width of the film, and a clearance at the tip end thereof was 1 mm. The wash nozzle was supplied with the cleaning liquid by a flow of 30 L/min through Astropore Filter of Fuji Photo Film Co., Ltd., which had a nominal fractional size of 0.2 $\mu$m.

Two ultrasonic generators of a custom-made model produced by Nippon Alex Ltd. were arranged along the width of the film in order to apply the ultrasonic waves over the whole width of the drive roller coated with the fluorinated rubber. One ultrasonic generator is 50 cm long along the width of the film and 30 cm long in the transport direction, and outputs the ultrasonic waves of 100 kHz with a power of 1,000 W.

The results of the experiments are shown in levels F–I in the table of FIG. 3. The levels F and G show the results of a test of a basic mode of the present invention wherein the methanol purified by the filter was jetted through the wash nozzle additionally to the comparative arts D and E. In the levels F and G, the amount of residual foreign matter was further decreased after the process of 50 m compared with the levels D and E. The amount of foreign matter was hardly increased even after the process of 3,000 m, and this indicates the excellent particle removal effect of the present invention.

In a level H, the ultrasonic generator was additionally operated in the level G. The amount of residual foreign matter was further decreased to approach 0.

In a level I, the drive roller was rotated in the film transport direction at a rotating speed of 100 rpm. In this case, a difference between the rotating speed of the drive roller and a linear velocity of the running film was 19 m/min. The amount of foreign matter was also decreased, and this means the excellent rubbing performance.

Moreover, the scratches on the film surface, which were formed in the prior arts of the levels A–C and the comparative arts of the levels D–E, were eliminated in the levels F–I, which proved excellent particle removal effect of the present invention.

According to the present invention, the running web is continuously rubbed with the elastic body wet with the liquid, and then the same purified liquid is supplied to the same surface of the web so that the surface of the web can be washed. This enables the precise and stable removal of the foreign matter, such as the debris, dust and the like adhering to the web without damaging the surface of the web.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A web particle removal method, comprising the steps of:

positioning a roller, which includes an elastic body on a periphery thereof, between an upstream guide roller and a downstream guide roller;

guiding a running web with the upstream and downstream guide rollers, to thereby bring a surface of the running web into contact with the elastic body at a positive lap angle with respect to the roller;

rubbing continuously the surface of the running web with the elastic body wet with a liquid; and after the rubbing step, spraying a liquid to the surface of the running web.

2. The web particle removal method as defined in claim 1, further comprising the step of applying an ultrasonic wave to the elastic body having rubbed the surface of the web, to thereby remove foreign matter from the elastic body.

* * * * *